US005458080A

United States Patent [19]

Jaramillo, Sr.; Alfonso

[11] Patent Number: 5,458,080

[45] Date of Patent: Oct. 17, 1995

[54] AUTOMATICALLY RETRACTABLE STEPS FOR WATERCRAFT

[76] Inventor: Alfonso Jaramillo, Sr., 20205 Lounsberry Dr., Lake Matthews, Riverside, Calif. 92370

[21] Appl. No.: 384,360

[22] Filed: Feb. 2, 1995

Related U.S. Application Data

[63] Continuation of Ser. No. 212,015, Mar. 11, 1994, abandoned.

[51] Int. Cl.[6] ..... B63H 11/02

[52] U.S. Cl. ..... 114/362

[58] Field of Search ..... 182/84, 85, 88–92; 114/343, 362, 270; 403/111, 144, 163; 280/166; D12/307, 317

[56] References Cited

U.S. PATENT DOCUMENTS

| | | | |
|---|---|---|---|
| 2,670,968 | 8/1951 | Duffy | 280/167 |
| 2,809,849 | 10/1957 | Benue | 182/91 |
| 3,313,374 | 4/1967 | Teach | 182/89 |
| 3,517,942 | 6/1970 | Cuffe et al. | 280/166 |
| 3,794,140 | 2/1974 | Sell | 114/362 |
| 3,825,097 | 7/1974 | Owen | 182/91 |
| 3,862,670 | 1/1975 | Hovey | 182/89 |
| 3,891,261 | 6/1975 | Finneman | 296/1 R |
| 3,986,503 | 10/1976 | Le Guillon | 182/89 |
| 4,191,388 | 3/1980 | Barksdale | 280/166 |
| 4,231,583 | 11/1980 | Learn | 280/166 |
| 4,556,125 | 12/1985 | Johnson | 182/91 |
| 4,688,508 | 8/1987 | Nishida | 114/362 |
| 4,712,503 | 12/1987 | Ritten | 182/86 |
| 4,926,965 | 5/1990 | Fox | 114/362 |
| 5,085,164 | 2/1992 | Whitton | 114/362 |
| 5,085,165 | 2/1992 | Reed | 114/362 |
| 5,152,244 | 10/1992 | Jarmillo, Jr. et al. | 182/89 |

OTHER PUBLICATIONS

Photograph facsimiles, sheets A, B, C, D.

*Primary Examiner*—Edwin L. Swinehart
*Attorney, Agent, or Firm*—Christie, Parker & Hale

[57] ABSTRACT

An automatically retractable step assembly for watercraft rotatably mounts to a fixed step assembly fixed to the craft, a movable sliding chassis mounted on tracks, or a manually retractable step. The automatically retractable step assembly can also rotatably mount to another automatically retractable step assembly. The automatically retractable step assembly is preferably formed by a U-shaped member with outward projections that rotatably fit over mating projections from a supporting element. The U-shaped member is biased by torsion springs to rotate with respect to the supporting elements towards a position in which the retractable step assembly will be stored and away from the water. The retractable step assembly, during use, is rotatable against the bias and towards or into the water by pulling or stepping on the retractable step.

16 Claims, 9 Drawing Sheets

2
6
3
14
6
6
16
14
10
6
12
4
34a
36a
24
20
38
22

102
98
114
122
124
102
104
138
114
112
116
100
130
142
148
141
134a
104
150
134
141
152
136

114
114
112
116
128
104
141
134
148
142
134a
112
130
141
150
142
152
136a
136
124
138
120
122

2
6
3
14
6
6
16
14
10
6
12
204
34a
34
239
224
36a
36
220
240
234a
238
350
234
236a
236
320
338
324
322

AUTOMATICALLY RETRACTABLE STEPS FOR WATERCRAFT

CROSS-REFERENCE TO RELATED APPLICATION

This is a continuation of application Ser. No. 08/212,015, filed Mar. 11, 1994, now abandoned.

1. Field of the Invention

The present invention relates to an automatically retractable step for a watercraft.

2. Background of the Invention

In watercraft, it has been popular to provide steps fixed to the craft to facilitate boarding from and unboarding to the water, such as for water skiing, jet skiing and swimming. Typically, there are two steps, one of which is fixed to the rear of the boat and the other is manually movable between folded and unfolded positions for use. The problem is that after a person unboards or boards the craft, the foldable step must be pulled upward for folding, so that it does not drag in the water. This folding process is cumbersome as it involves leaning far over the stern of the craft and reaching down and pulling up the foldable step. This is particularly hard for children to do. Some existing boats have a single movable step movably mounted on guide rails, but this step suffers from the same drawbacks as the above steps.

U.S. Pat. No. 5,152,244 discloses a retractable stirrup for a jet watercraft, but this stirrup is mounted to brackets fixed to the craft. It is not connected to another step or to movable rollers.

What is needed are steps that can retract automatically with respect to a fixed step or a movable step on guide rails that can retract automatically.

SUMMARY OF THE INVENTION

The invention is directed to an automatically retractable step assembly for watercraft, which attaches to a fixed step assembly attached to the craft, mounts on movable sliding members, or mounts to another automatically retractable step.

In one embodiment, the invention provides an automatically retractable step formed by a U-shaped member with outward projections that rotatably fit over mating projections from a supporting element. Means for biasing the U-shaped member to rotate with respect to the supporting elements, such as a portion spring, is located inside the U-shaped member and extends between the supporting element and the U-shaped member.

In a preferred embodiment, the supporting elements are male projections from an elbow-shaped member, which elbows either mount to the bottom of rods forming the sides of a fixed step or a manually pivotably step with respect to the craft. In another preferred embodiment, the supporting elements are mounted on rollers for slidable motion with a track.

DETAILED DESCRIPTION OF THE PREFERRED EMBODIMENT

Figure 1:
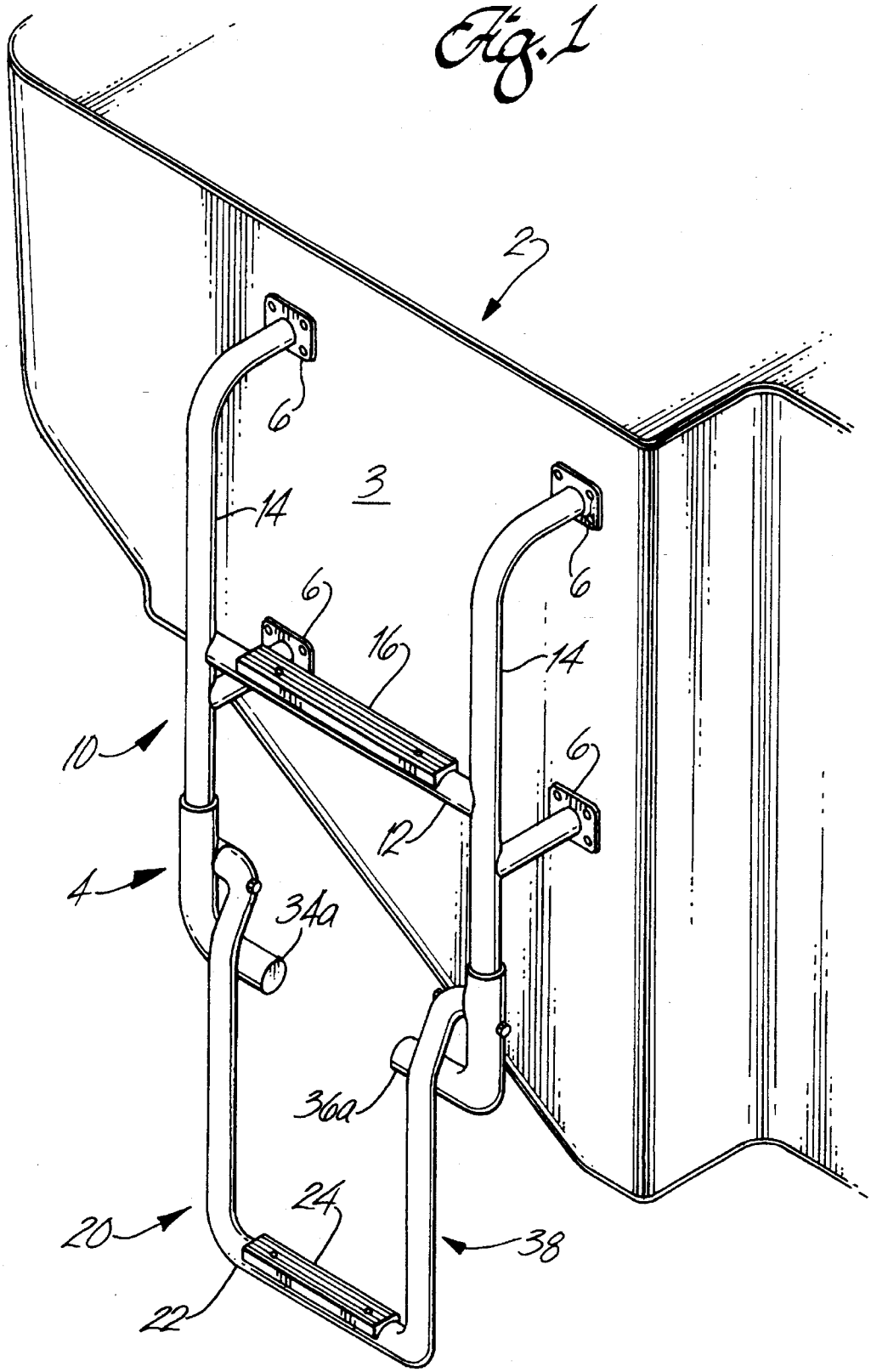
FIG. 1 is a perspective view of the rear of a watercraft on which a step assembly according to a first embodiment of the invention are mounted.

With reference to FIG. 1, a watercraft 2, e.g., a boat, has a stern panel 3 with a step assembly 4 mounted thereon at four brackets 6 by bolts. The step assembly 4 includes a fixed step assembly 10 formed by a rung 12 and two tubular support bars 14. On the rung 12 is a plastic pad 16 which is fixed to the rung 12. The step assembly also includes a retractable step assembly 20 rotatably mounted to the support bars 14 of the fixed step. The step 20 has a rung 22 with a plastic pad 24.

Figure 2:
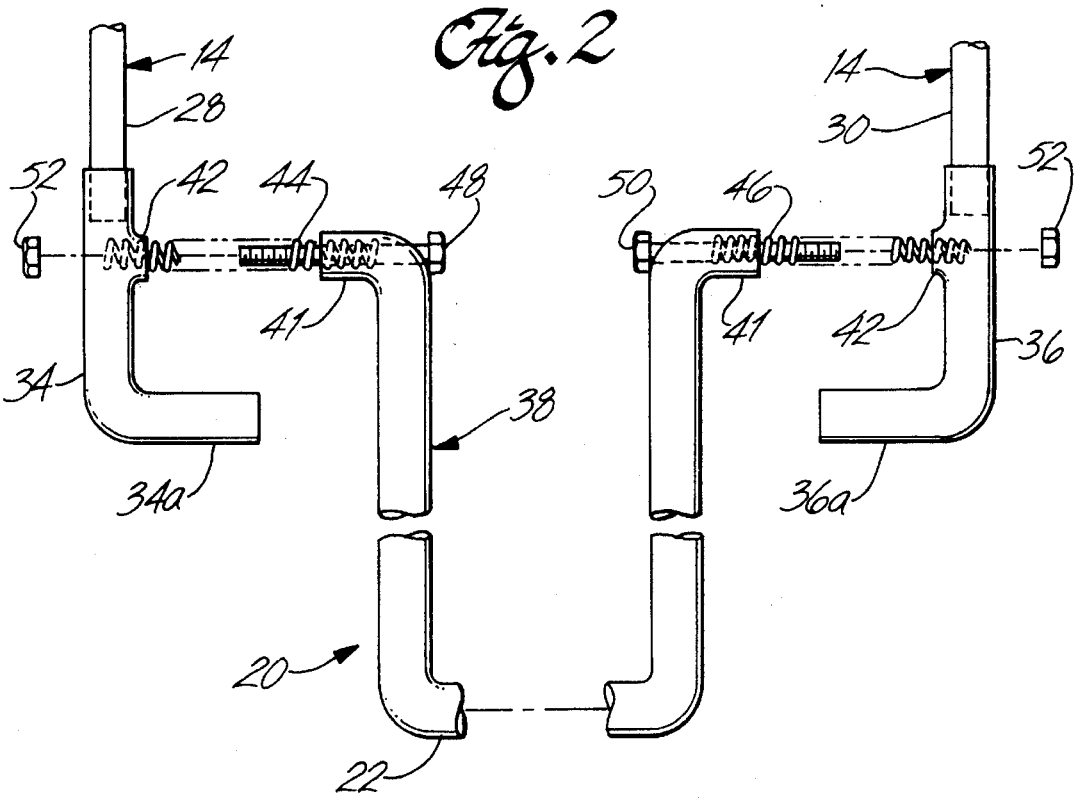
FIG. 2 is an enlarged, exploded perspective view of a portion of the step assembly of FIG. 1.

With reference to FIG. 2, the support bars 14 are formed by two rods 28, 30 and two elbow members 34, 36. The retractable step assembly 20 includes a U-shaped tubular member 38 of which the bottom forms rung 22. The U-shaped tubular member 38 is mounted by outward-directed female mounting portions 41 around male projection 42 to provide support yet achieve a rotatably joint. The rods 28, 30 fit into the tops of elbow members 34, 36, respectively, and are fixed thereto by welding or other appropriate means. Inside the joint where the U-shaped member 38 and the elbow members 34, 36 mate are right-hand and left-hand torsion springs 44, 46, respectively, mounted around bolts 48, 50 fixed by nuts 52 to hold the U-shaped member and elbow members together. In assembly, the elbow is provided separate from the rods 28, 30 so that the springs can be loaded by winding the elbows then mounting the elbows to the rods. The elbows include stopper portions 34*a*, 36*a* which limit the rotation of the U-shaped member 38.

Figure 3:
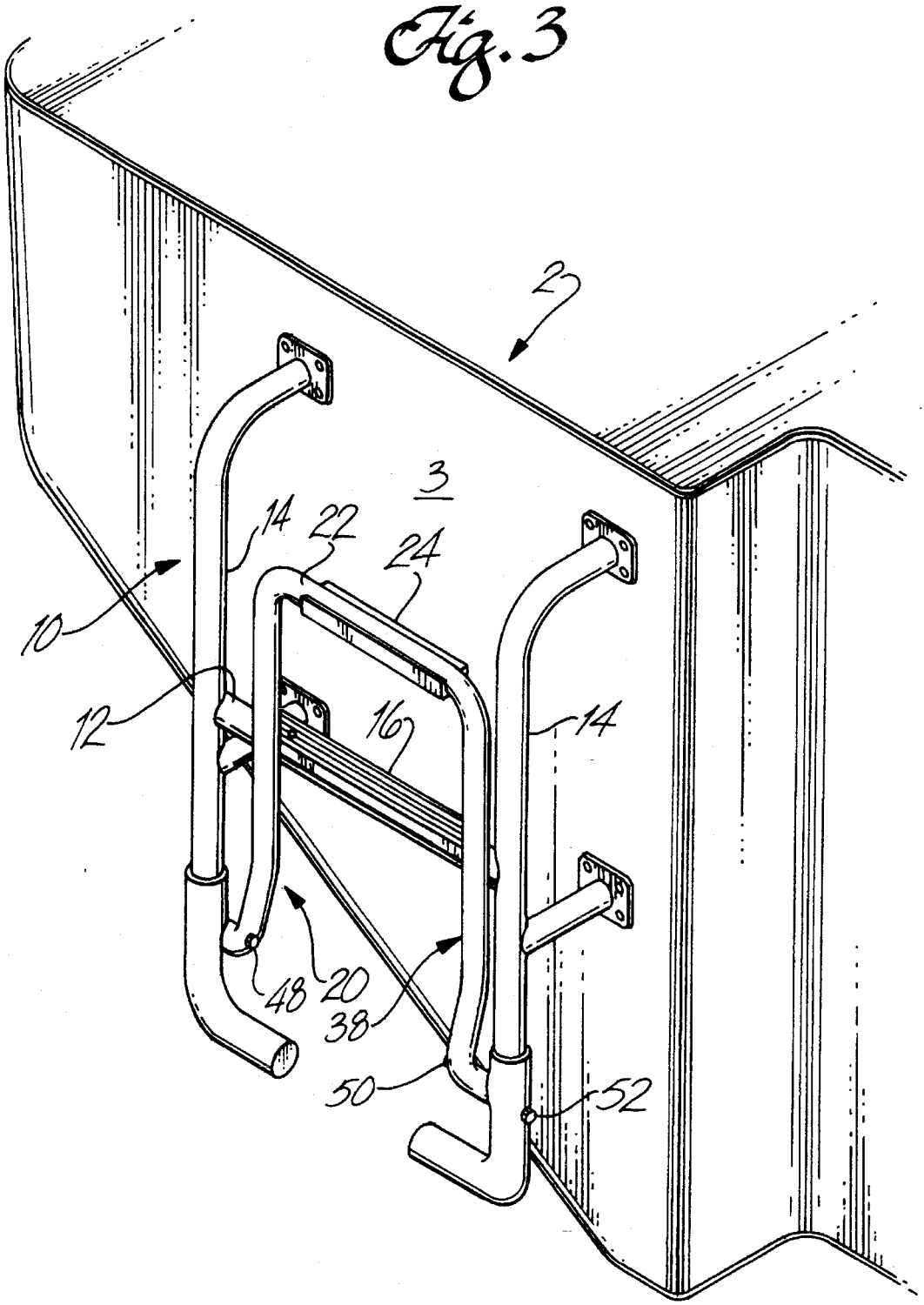
FIG. 3 is a view similar to FIG. 1 but showing a retractable step of the assembly in retracted position.
Figure 4:
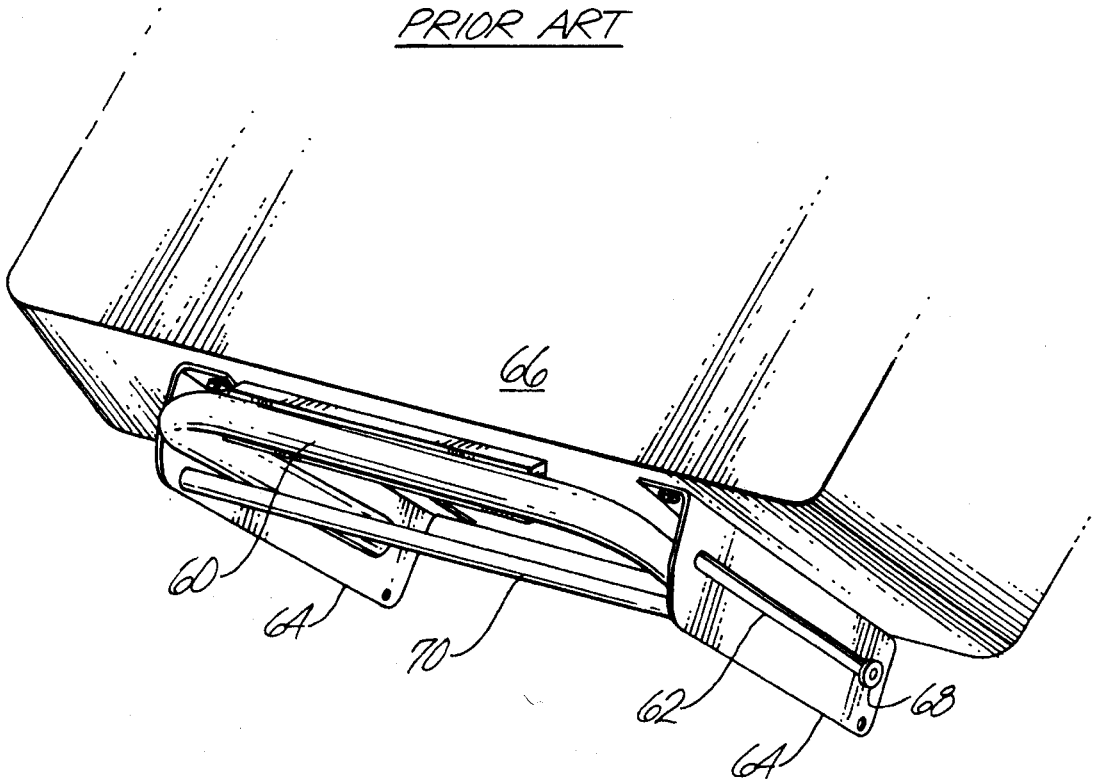
Fig. 4 PRIOR ART
FIG. 4 is a perspective view of the rear of a watercraft on which a conventional slidable step assembly is mounted.

In use, with reference to FIG. 3, a person unboarding from the boat steps on the fixed rung 12 pushes the movable rung 22 down towards and into the position of FIG. 1 then by stepping onto the rung 22, which will often be in the water in its fully operative position. The user then enters the water, and the retractable step 20 rotates upward due to the spring bias to the position of FIG. 3, until the step is stopped by fixed rung 12, so that the retractable step will not drag in the water.

The step assembly is preferably made of stainless steel or aluminum, except for the plastic pads which may also be rubber or simply a flutter rougher are of the rung.

With reference to FIGS. 4–7, a second embodiment of the invention will be explained. In this embodiment, a single step is on rollers mounted on a track. It has been conventional to mount a U-shaped step 60 with hinge pins (not shown) extending through slots 62 in a pair of guide rails 64 bolted to the underside of a stern panel 66 of a watercraft. The pins are fitted with washers 68 or the like to stay in the slots 62. A bar 70 holds the step in a vertical position when the step is pulled out, and allowed to drop, usually into the water.

Figure 5:
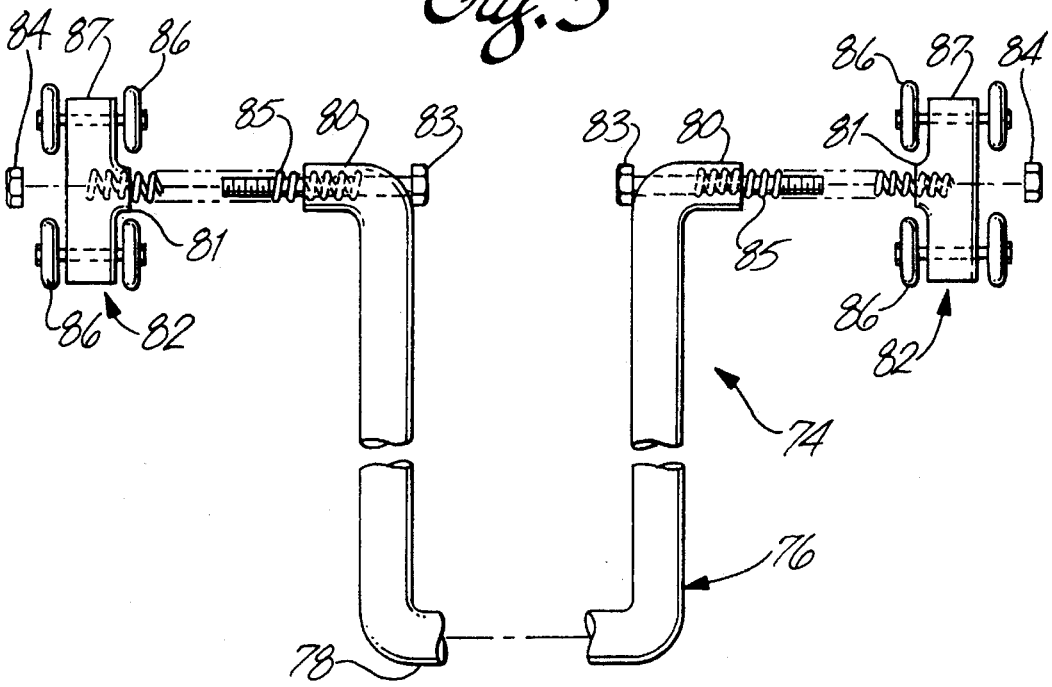
FIG. 5 is an enlarged, exploded perspective view of a step assembly according to a second embodiment of the invention.

FIG. 5 shows a step assembly 74 according to the second embodiment, in which a U-shaped member 76 is constructed like member 38 of the first embodiment to include an integral rung 78, a plastic pad (not shown), and outward-turned female mounting portions 80. Annular projections 81 of roller assemblies 82 rotatably receive the mounting portions 80 to support the U-shaped member 76. The member 76 is attached to the roller assemblies 82 by means of bolts 83 and nuts 84, which bolts have torsion springs 85, 86 mounted thereon in the same manner as in the first embodiment.

Figure 6:
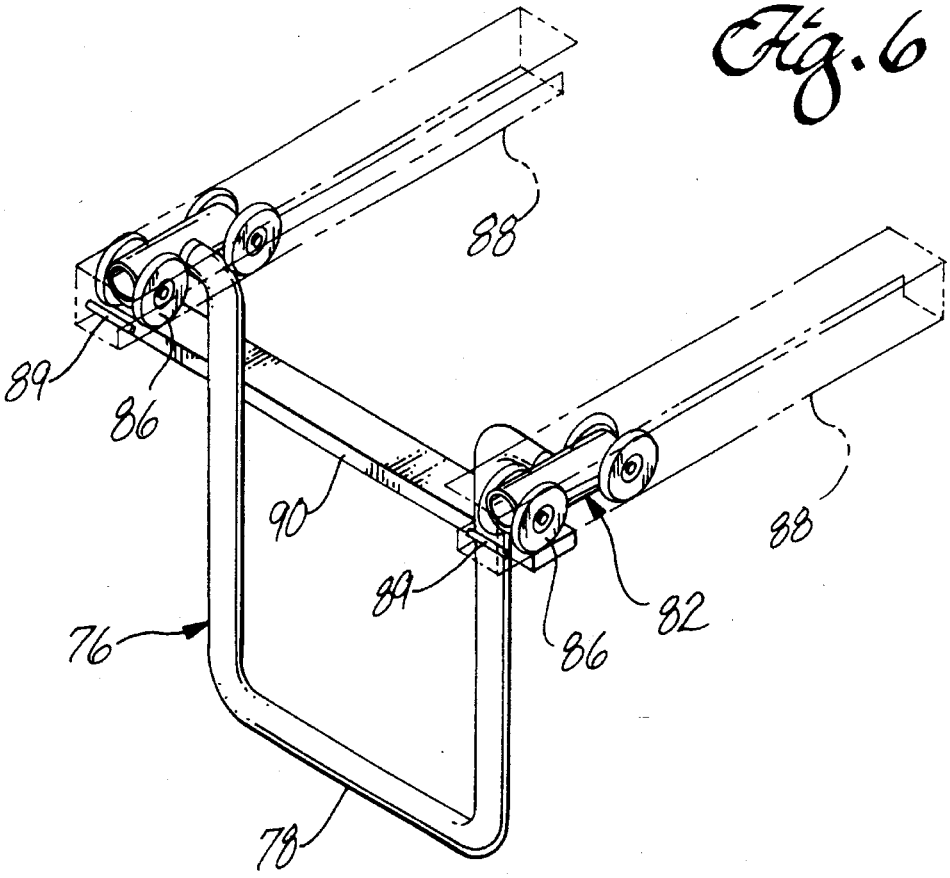
FIG. 6 is a view similar to FIG. 4 but showing the step assembly of FIG. 5 in an extended and rotated downward position.
Figure 7:
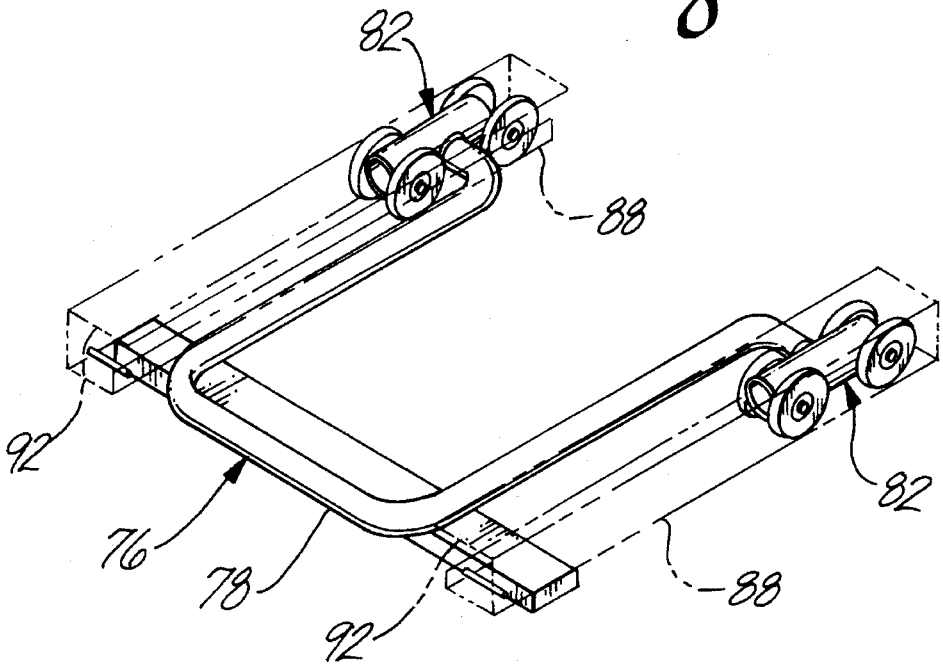
FIG. 7 is a view similar to FIG. 6 but showing the retractable step in a retracted and storage position.

The roller assemblies 82 each have wheels 86, e.g., four wheels rotatably mounted to a chassis 87 on which the annular projections 81 are formed. The rollers, as shown in FIGS. 6 and 7, ride in tracks 88, which are bolted to the underside of the stern of the boat as are the guide rails in FIG. 4. The person getting on or off the boat will pull the U-shaped member 76 by rung 78 from the retracted position of FIG. 7. The person will then push the member down with his feet or pull it down until it can be stepped on and thus moved to the position of FIG. 6 and held there by a stopper bar 90. The person will then get off the step into the water or get on board the craft. The U-shaped member will stay on the track due to the forward most wheels 86 contacting stopper pins 89 at the end of the tracks 88.

When the person steps off of the rung the spring bias will cause the member 76 to rotate upward until the it hits tops 92 of the tracks 88, which tops extend toward each other beyond the bottoms of the tracks, so as to form a stopper for the member 76. From this position, the U-shaped member position will be in a plane parallel with the tracks so it can readily be pushed into the position of FIG. 7 without having to reach down into the water.

Figure 8:
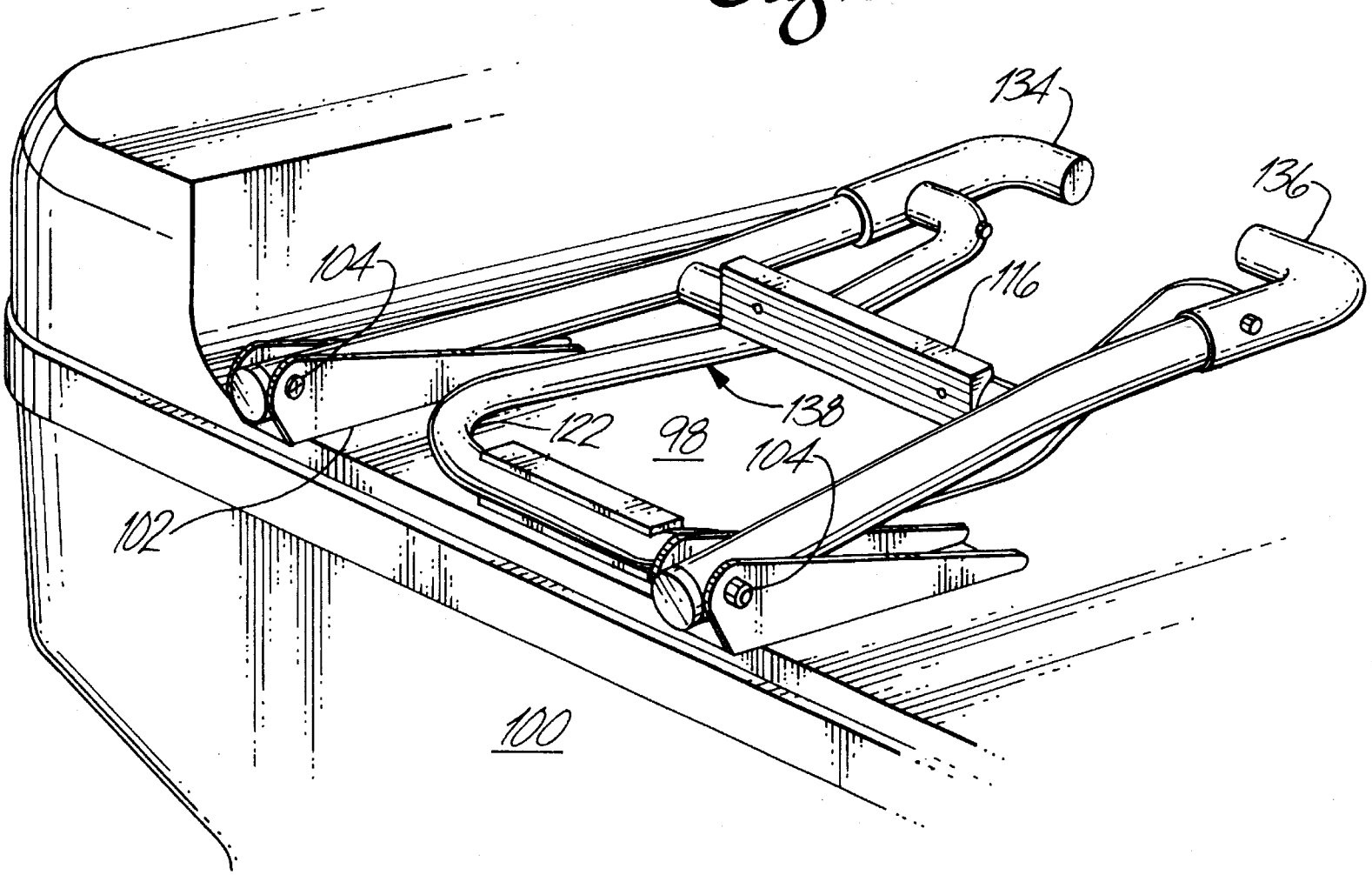
FIG. 8 is a perspective view of the rear of a watercraft on which a step assembly according to a third embodiment of the invention is mounted in retracted and folded position.

In a third embodiment of the invention, which is described with reference to FIGS. 8–10, the step assembly is fastened to a flat top 98 of a stern panel 100 of a watercraft, by means of brackets 102 and bolts (not shown), and the entire assembly manually pivots on pins, as in conventional step assemblies of this type.

Figure 10:
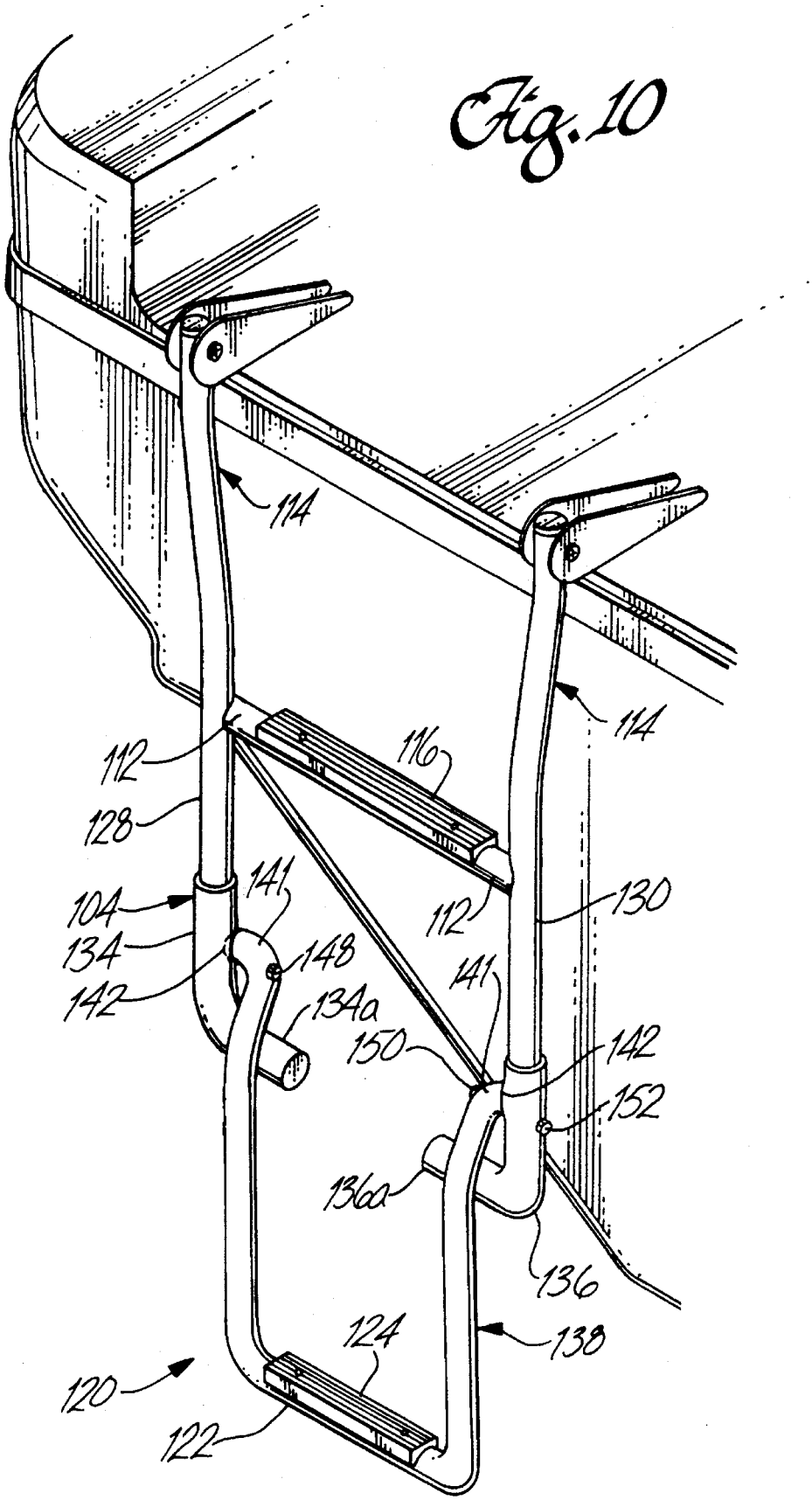
FIG. 10 is a view similar to FIG. 9 in which both of the steps are fully unfolded and operative.

With reference to the completely unfolded view of FIG. 10, step assembly 104 includes a first fixed step assembly 110 formed by a rung 112 and two tubular support bars 114. On the rung 112 is a plastic pad 116 which is fixed thereto. The step assembly 104 also includes an automatically retractable step assembly 120 rotatably mounted to the support bars 114 of the manually rotatable step assembly 104. The automatically rotatable step assembly 120 has a rung 122 with a plastic pad 124.

The support bars 114 are formed by two rods 128,130 and two elbow members 134, 136. The step assembly 120 includes a U-shaped tubular member 138, of which the bottom forms a rung 122. The U-shaped tubular member 138 is mounted by outward-directed female mounting portions 141 on projections 142 from the elbow members 134, 136 to provide support, yet achieve a rotatable joint. The rods 128, 130 fit into the elbow members 134, 136 respectively, and are fixed thereto by welding or other appropriate means. Inside the joints of the U-shaped member 138 and the elbow members 134, 136 are right-hand and left-hand torsion springs mounted around bolts 148, 150, respectively and fixed by nuts 152 which hold the U-shaped member 138 and elbow members together, as in the first two embodiments. The elbows include stopper portions 134*a*, 136*a* which limit the downward rotation of the U-shaped member 138 to a substantially vertical operational position. During assembly, the elbows are provided so that the springs can be loaded by winding the elbows, and then mounting the elbows to the support rods.

Figure 9:
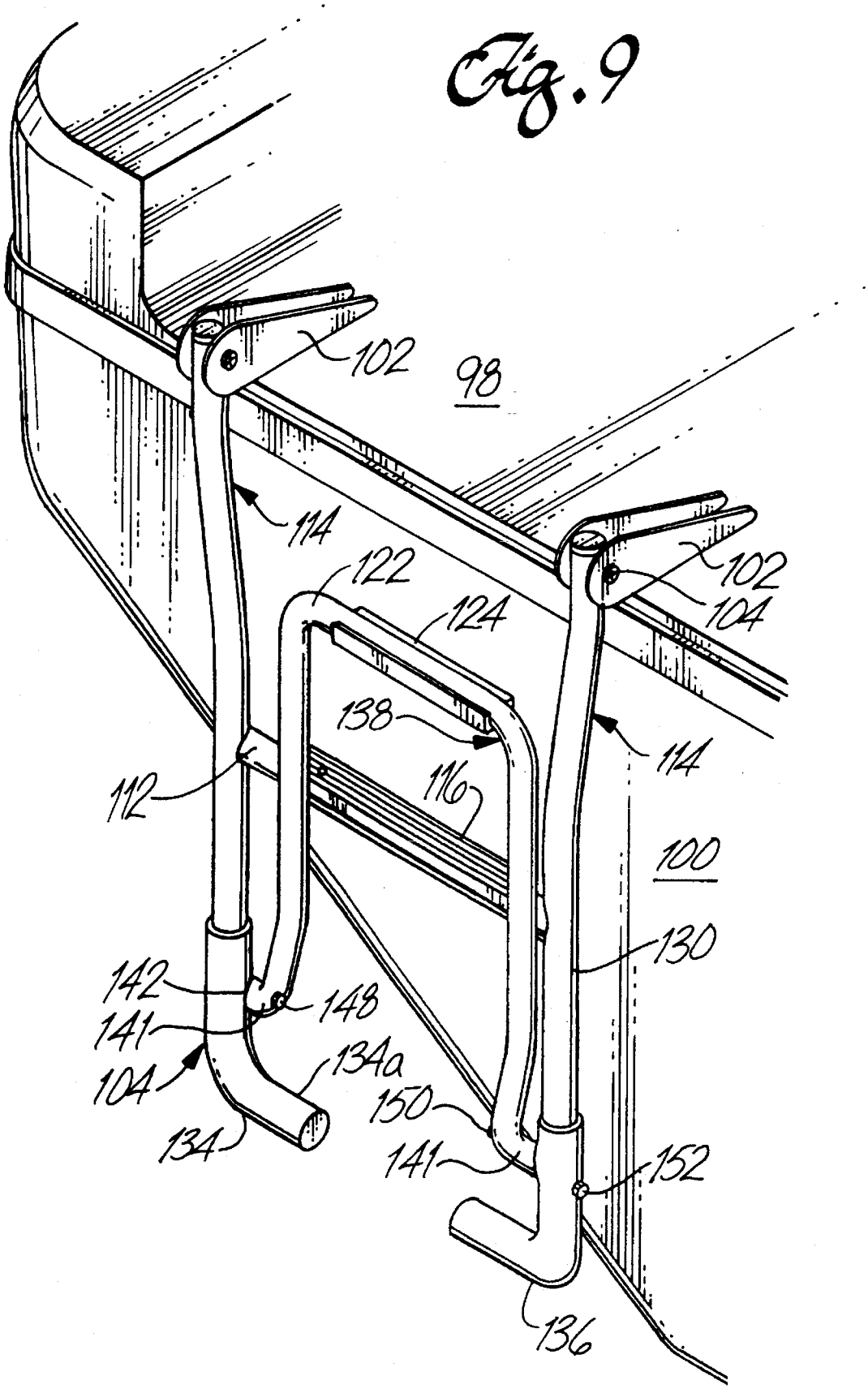
FIG. 9 is a view similar to FIG. 8 in which only one of the steps in the assembly is in retracted position.

In use, a person boarding from the water can either reach up and grab the rung 122 from the U-shaped member 138 (see FIG. 8), or someone on the boat can manually rotate the entire assembly about the pins 104, e.g., by picking it up at elbows 34, 36 so that the assembly is in the position of FIG. 9. Then, the person in the water can grab the upwardly biased U-shaped member 138 at rung 122 and pull it downward. It will stop at the portion where the U-shaped member 138 contacts the stopper portions 134*a*, 136*a*, as shown in FIG. 10. The person in the water can then step on pad 124 and then onto pad 116 U-shaped member 138 will then rotate upward once pressure is off it until it contacts the rung 112 of the fixed assembly (the position of FIG. 9). It should be noted that the spring bias should be strong enough to pull the step upward to the vertical position, even from under water but no so strong that the step will injure the person climbing onto the boat.

A fourth embodiment of the invention will now be described with reference to FIG. 11. In this embodiment, there are two automatically rotatable step assemblies. A fixed step assembly 10 is the same as in the embodiment of FIG. 1. However, a fixed step assembly as in the embodiment of FIG. 8 could be used. The entire step assembly 204 further includes a first automatically rotatable step assembly 220 pivotably mounted to the fixed assembly and a second rotatable assembly 320 pivotably mounted to the assembly 220. The first rotatable step assembly 220 is mounted to the fixed step assembly 10 in the exact same way as the rotatable step assembly of FIG. 1 is mounted to the fixed step assembly 10 therein. However, in the step assembly 220, the U-shaped member is replaced with a substantially H-shaped member 238 having a rung 222 running between two vertical rods 239, 240 which will serve as a stopper for the second rotatable step assembly. On the rung is a plastic pad 224. At the bottom of the H-shaped member are two elbow members 234, 236 which are the same or substantially the same as elbow members 34, 36. The second rotatable step assembly 320 is substantially identical to the single rotatable member of FIG. 1 and is fixed to the elbows 234, 236 in identical fashion as the U-shaped member 38 of FIG. 1 is attached to the elbow members 34, 36. The U-shaped member 38 has a rung 322 and a plastic pad 324 thereon. The rotation of the member 338 is limited by stoppers 234*a*, 236*a* of the elbows 234, 236. These stoppers 234*a*, 236*a* could be connected by a male or female rod therebetween represented by dashed lines 350 to provide an additional step or a step in place of the step 222. The same is true for the stoppers 34*a*, 36*a*.

Figure 11:
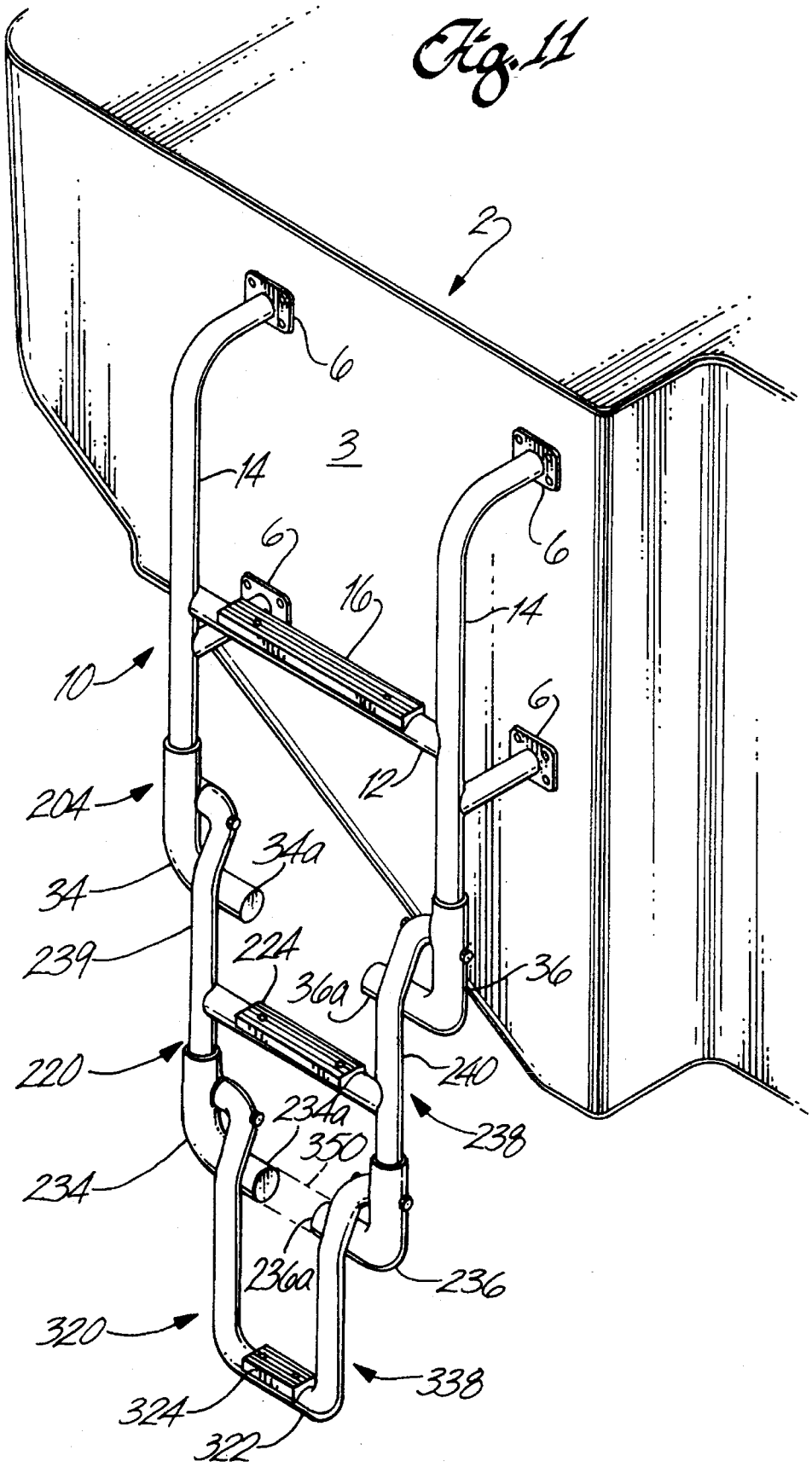
FIG. 11 is a view, similar to FIG. 1, of a fourth embodiment of the invention where there are two automatically retractable steps.

The step assembly of FIG. 11 will fold up by the second step assembly 320 rotating upward until it contacts the step 222 (or a stopper may be provided) and the first step assembly 220 will then be rotating up until it contacts rung 12.

While the present invention has been described with respect to preferred embodiments, it can readily be seen that many variations will be evident to one of ordinary skill in the art, and thus, the invention is measured by the appended claims rather than the specifications. For example, the elbow members or movable support chassis can have projections facing outward and the rotatable step assembly could then mount on the outside of the elbow members rather than to the inside. Moreover, the male and female relationships of the different rods and elbow members could readily be reversed.

I claim:

1. An automatically retractable step assembly for watercraft, comprising:

a fixed step assembly including means for mounting the fixed step assembly to the watercraft and means for defining a first step;

a retractable step assembly for rotatably mounting to the fixed step assembly, including means for defining a second step; and the retractable step assembly and the fixed step assembly cooperate to form two joints, each joint comprising a male tubular member and a female tubular member having a common axis and the tubular member of the retractable step assembly being freely journaled to the tubular member of the fixed step assembly for rotation about the common axis, and a means for biasing the tubular member of the retractable step assembly to rotate the retractable step assembly towards a storage position in which the fixed and retractable step assemblies are folded substantially together.

2. The step assembly as claimed in claim 1 wherein the fixed step assembly has means for stopping the rotation of the retractable step assembly in a direction opposite to the bias of the retractable step assembly so that the retractable step assembly will be held in an operational position in which the fixed and retractable step assemblies are unfolded when a user steps on it.

3. The step assembly as claimed in claim 1 wherein a second retractable step assembly is mounted to the first retractable step assembly in identical manner as the first retractable step assembly is mounted to the fixed step assembly.

4. An automatically retractable step for a watercraft, comprising:

two tracks for being fixedly mounted to the watercraft;

two means for moving along the tracks; and a U-shaped member for cooperating with the two means for moving to form two joint means for rotatably mounting the U-shaped member to the two means for moving, and means for biasing the U-shaped member to rotate from a substantially vertical operational position to a substantially horizontal position where it is substantially parallel with the tracks, and wherein each joint means comprises a male tubular member and a female tubular member having a common axis and the tubular member of the U-shaped member being journaled to the tubular member of the means for moving for rotation about the common axis with respect to the tubular member of the means for moving.

5. The step assembly as claimed in claim 4 wherein the two tracks each comprise means for stopping the rotation of the step assembly in the direction of its bias at the substantially horizontal position where the U-shaped member is substantially parallel to the tracks.

6. An automatically retractable step assembly for watercraft, comprising:

a manually rotatable step assembly including means for mounting the manually rotatable step assembly to the watercraft;

a retractable step assembly; and means for rotatably mounting the retractable step assembly to the manually rotatable step assembly and a means for biasing the retractable step assembly to rotate the retractable step assembly to the storage position, the means for rotatably mounting and the manually rotatable step assembly cooperating to form two joints each comprising a male tubular member and a female tubular member having a common axis and the tubular member of the retractable step assembly being freely journaled to the tubular member of the manually rotatable step assembly for rotation about the common axis with respect to the manually rotatable step assembly.

7. The step assembly as claimed in claim 6 wherein the fixed step assembly has means for stopping the rotation of the retractable step assembly in a direction opposite to the bias of the retractable step assembly so that the retractable step assembly will be held in an operational position in which the fixed and retractable step assemblies are unfolded when a user steps on it.

8. The step assembly as claimed in claim 6 wherein a second retractable step assembly is mounted to the first retractable step assembly in identical manner as the first retractable step assembly is mounted to the fixed step assembly.

9. An automatically retractable step assembly for watercraft, comprising:

a substantially U-shaped member for defining a step at a base of the U-shape, mounting means for supporting the U-shaped member against the force of a person stepping thereon, wherein the U-shaped member and mounting means each cooperate to form a pair of joint means each for forming a rotatable joint, and means are disposed inside each rotatable joint for biasing the U-shaped member to rotate in one direction, and wherein the joint means each comprise a male tubular member and a female tubular member having a common axis and the tubular member of the U-shaped member being freely journaled to the tubular member of the mounting means for rotation about the common axis with respect to the mounting means.

10. The step assembly as claimed in claim 9 further comprising first means for stopping rotation of the U-shaped member in the one direction when the U-shaped member is in a non-use position and second means for stopping rotation in the U-shaped member of a direction opposite to the one direction when the U-shaped member is in a usable position.

11. The step assembly of claim 1 wherein the means for biasing comprises a torsion spring.

12. The step assembly of claim 4 wherein the means for biasing comprises a torsion spring.

13. The step assembly of claim 6 wherein the means for biasing comprises a torsion spring.

14. The step assembly of claim 9 wherein the means for biasing comprises a torsion spring.

15. An automatically retractable step assembly for watercraft, comprising:

a substantially U-shaped member for defining a step at a base of the U-shape, mounting means for supporting the U-shaped member against the force of a person stepping thereon, wherein the U-shaped member and mounting means each cooperate to form a pair of joint means each for forming a rotatable joint, and there are means for biasing the U-shaped member to rotate in one direction, and wherein the joint means each comprise a male tubular member and a female tubular member having a common axis and the tubular member of the U-shaped member being freely journaled to the tubular member of the mounting means for rotation about the common axis with respect to the mounting means.

16. The step assembly of claim 15 wherein the means for biasing comprises a torsion spring located inside each rotatable joint.

* * * * *